United States Patent [19]

Borges

[11] Patent Number: 4,700,654

[45] Date of Patent: Oct. 20, 1987

[54] PROPULSION DEVICE FOR SWIMMERS AND DIVERS

[76] Inventor: Michael Borges, 3256 S. Main #41A, Santa Ana, Calif. 92707

[21] Appl. No.: 879,344

[22] Filed: Jun. 27, 1986

[51] Int. Cl.[4] ..... B63B 21/00

[52] U.S. Cl. ..... 114/338; 440/6; 440/67; 440/70

[58] Field of Search ..... 440/1, 6, 49, 66–71, 440/76, 77; 114/312, 315, 336–338

[56] References Cited

U.S. PATENT DOCUMENTS

| | | | |
|---|---|---|---|
| 1,512,391 | 10/1924 | Abraham | 440/6 |
| 1,579,529 | 4/1926 | Haschke | 440/6 |
| 2,543,078 | 2/1951 | Varney | 440/6 |
| 2,722,021 | 11/1955 | Keogh-Dwyer | 9/21 |
| 3,034,467 | 5/1962 | Pestronk | 114/16 |
| 3,128,739 | 4/1964 | Schultz | 115/6.1 |
| 3,329,118 | 7/1967 | Strader | 114/338 |
| 3,422,787 | 1/1969 | Rush | 115/6.1 |
| 3,441,952 | 4/1969 | Strader | 440/6 |
| 3,635,188 | 1/1972 | Rutkowski | 115/6.1 |
| 3,685,480 | 7/1972 | Peroni | 440/6 |
| 3,789,792 | 2/1974 | Smith | 115/6.1 |
| 3,916,814 | 11/1975 | Bardoni | 115/6.1 |
| 3,995,578 | 12/1976 | McCullough . | |
| 4,220,110 | 9/1980 | Roberson . | |

FOREIGN PATENT DOCUMENTS

| | | | |
|---|---|---|---|
| 826629 | 1/1938 | France . | |
| 125859 | 5/1919 | United Kingdom | 114/16 |

*Primary Examiner*—Jeffrey V. Nase
*Assistant Examiner*—Clifford T. Bartz
*Attorney, Agent, or Firm*—James D. Thackrey

[57] ABSTRACT

A motorized propulsion device for swimmers and scuba divers which is to be attached to the user's forearms. The battery, motor, propeller and propeller shroud are arranged in a compact, linear, hydrodynamic manner. The watertight housing may have one or more integrally shaped nesting protuberances to comfortably accommodate the user's forearm and thereby prevent slippage. The front end surface of the housing has a control panel within reach of the user's fingers.

5 Claims, 3 Drawing Figures

PROPULSION DEVICE FOR SWIMMERS AND DIVERS

FIELD OF INVENTION

This invention relates to motorized swimming and diving devices, specifically to an improved propulsion device for persons engaged in swimming, snorkeling, skin diving and scuba diving.

DESCRIPTION OF PRIOR ART

Although prior art has taught a variety of motorized swim and scuba diving aids, none of the prior art has suggested attachment of these devices to the user's forearms.

SUMMARY

My invention consists of arranging the control switch, battery, motor, and propeller with shroud in a linear manner, the first three of these being in a watertight housing designed to be strapped to the user's forearm.

Accordingly several objects and advantages of my invention are compactness, lightweightness, mutually independent operations ease of maneuverability, and fingertip controlability.

The compactness and low weight of units makes them ideal for secure attachment to a swimmers or scuba divers forearms. The strapping means allows units to be securely strapped to users forearms thereby eliminating the chance of losing units or losing control of said units. Compared with larger and heavier units currently on the market, general mobility is greatly increased during entry or exit of pool, beach, lake or ocean environments. Furthermore, directional control and maneuverability is quick and easy to learn. Being towed by the propulsion devices securely strapped to users arms is not tiresome to the hands or arms of user and thereby also provides a high degree of steering ease and ability when navigating through water. Furthermore, fingers and hands are left generally free to manipulate other objects as needed such as masks, snorkels, regulators, spear guns, nets, tools or camera equipment.

Still further objects and advantages are to provide propulsion units that are compact and completely self contained in regard to motor, energy source, fingertip speed control switches and optional lighting means for night time or deep diving. Further objects and advantages of the invention will become apparent from a consideration of the drawing and ensuing descriptions.

DETAILED DESCRIPTION OF THE INVENTION

Figure 1:
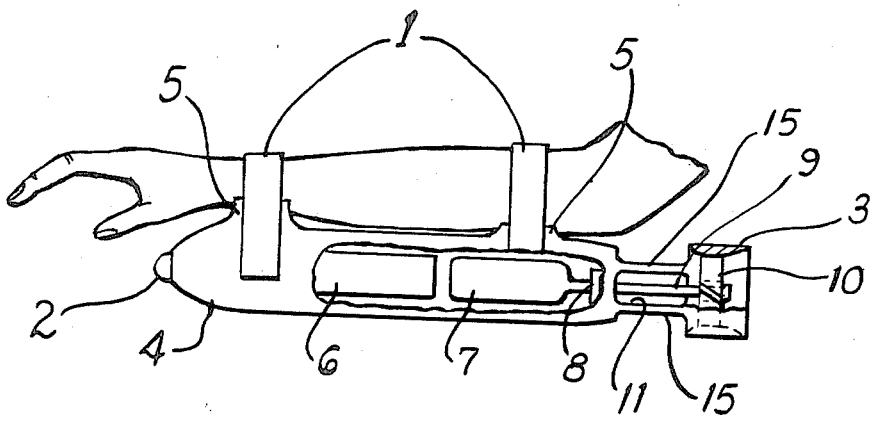
FIG. 1 is a side view of the preferred embodiment with portions thereof broken away to show the interior.

FIG. 1 shows the preferred embodiment of the invention. The invention has a watertight housing 4 and is shaped substantially cylindrical and allows space inside for a battery 6 to drive motor 7 as controlled by an on/off motor switch 2 at the front end of the unit.

The propeller shaft 9 is an extension of motor 7 and protrudes through a rotary seal 8 to prevent water from entering the housing. The shroud mount 15 extends from the back of housing 4 to the propeller shroud 3 thereby holding said propeller shroud securely in place. The propeller is attached at the end of propeller shaft 9. The space between the shroud mounts 15 and the propeller shaft 9 in front of propeller shroud 3 acts as the water intake channel 11.

The watertight housing unit 4 has connected to it a multiplicity of attachment straps 1 which are arranged perpendicularly to the horizontal length of the watertight housing 4.

The nesting protuberances 5 are designed to be an integral part of watertight housing 4 to facilitate comfort and security when the invention device is attached to a users forearm.

Figure 2:
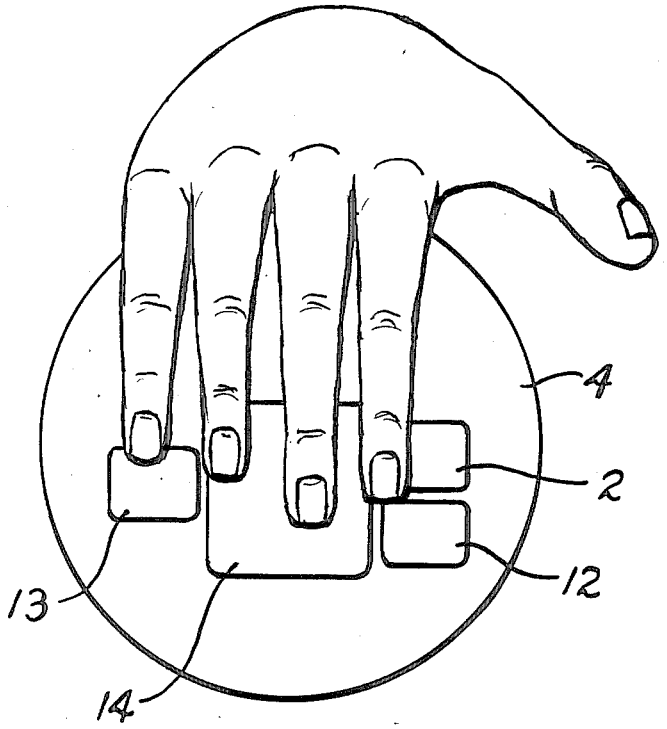
FIG. 2 is an enlarged frontal view of an alternative forward surface of the invention incorporating a control switch panel which allows space for inclusion of a headlamp or like lighting means.

An alternative configuration of control options is shown at the front end of the watertight housing 4, FIG. 2. A speed control 12 is placed near the on/off motor switch 2. Furthermore a lamp switch 13 controls electric lamp 14 for purposes of night time use or deep diving in dark areas.

Figure 3:
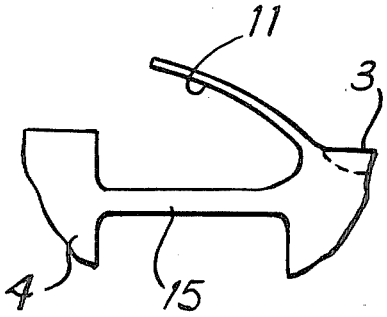
FIG. 3 is an enlarged side view showing an alternative water intake channel at the back end of the propulsion device.

FIG. 3 shows an alternative propeller shroud 3 with a ramification on the original water intake channel 11 shown in FIG. 1. The water intake channel 11 shown in FIG. 3 protrudes sideways and so scoops in more water in order to increase propeller thrust efficiency. In addition FIG. 3 shows the back end of watertight housing 4 as well as a shroud mount 15 which holds propeller shroud 3 in place.

The drawing reference numerals will be discussed individually as to function and variation of embodiments and design ramifications.

1 strap attachments—are made of suitably wide nylon fabric with a plastic buckle on one end and adjoining velcro type fasteners sewn on the top surface of the other end. The velcro end is pulled through the buckle loop until snugly tightened and then pressed down firmly back over itself and thereby held firmly by the said velcro strips to prevent slippage. The velcro strips are long enough to allow for enough adjustment flexibility so as to accommodate a range of small to large forearms of users. Variations on materials of straps would include fibers, fabric, cloth, canvass, rubber, plastics, metal or a combination of the like.

Mechanical variations of strap buckling or fastening systems may also include employment of bindings, zippers, ties, hitches, chains, flexibands, yokes, brackets, clasps, laces, clamps or a combination of the like.

Any of the above mentioned straps may be designed as either separate pieces as shown in FIG. 1 or made to completely encircle the entire unit as one continuous piece.

2 on/off motor switch—is comprised of a direct current toggle switch covered by a watertight boot to prevent water entry into the housing. Variations of such switch would include a turn on/off switch or a push on/push off type switch. More sophisticated ramifications might include forms of electronically operated magnetic or touch sensor activated switches.

3 propeller shroud—is made of aluminum with a Kort nozzle type intake and exit formation. Variations on materials could include but not be limited to plastics, fiberglass, stainless steel, hardened rubber or similar resins and the like.

4 watertight housing—is made of PVC plastic. It is therefore very lightweight, watertight and strong to withstand the great pressures of deep diving environments. The housing may also be constructed of such materials or combinations thereof as other plastics such as ABS, resins or metals accomplishing the purposes of being generally rust proof, having great strength and a minimum of weight.

5 nesting protuberance—is human engineered to provide for a range of forearm sizes of users. A gentle concave wedge shaped indentation is constructed along top side of watertight housing 4. Although nesting is not absolutely necessary to functional operation of the device, any sort of protuberances would generally assist the user in terms of comfort and anti-slippage security.

6 battery—a custom nickel-cadmium pack is used at 10 volts with 7 ampere hours of discharge capacity. The nicads are rechargeable and may be used several hundred times for over a period of 2 years. Other batteries may be used within the scope of rechargeability, compactness, power output parameters and economy of use.

7 motor—a 12 volt direct current single shaft motor is used in the preferred embodiment. However, any type motor in terms of torque, rpm, weight, size and type of materials may be utilized as to satisfy the purpose of driving a propeller efficiently through water and simultaneously provide the desired levels of thrust required to propel a swimmer or diver through the water. 8 rotary seal—device uses a conventional single lip seal. A similar spring loaded seal or two such seals back to back would provide a more secure lip. A double lip seal system may also be used.

9 propeller shaft—is made of stainless steel and extends far enough to reach at least beyond the center of propeller shroud 3.

10 propeller—is approximately 3 inches in diameter keeping within the inventions spirit of compactness. The propeller utilizes 3 blades for maximum efficiency and minimum vibration. The propeller is made of brass and secured by a nut. The propeller may take on a larger diameter and may also be fashioned of rust proof metals or even a variety of plastics. Various pitches of props could be made available to meet the needs of a variety of speed and task requirements.

11 water intake channel—naturally surrounds inward areas between the shroud mounts 15 to admit water toward the propeller 10. A variation is shown in FIG. 3 whereby additional water intake channels are provided by the placement of a scoop or cowl protruding beyond the surface of the housing. Such as mentioned scoops or cowls may be in a few sections or a continuous piece surrounding the entire propeller shroud unit. A grille or strainer may be placed at the front end of the water intake channel 11 (FIG. 3) to prevent debris from clogging the shroud and or fouling the propeller.

12 speed control—incorporates a pulse width modulator controlled by a push button step up (looped to) step down amperage draw circuit. This in effect controls rpm of the dc motor and hence makes it possible to adjust the speed of units. A ramification includes having one or more preset options on a voltage bypass as conventionally used with resistor and transistors. The pwm, pulse width modulator, is currently easily available, and is also the state of the art in small dc type controlling of said motor speeds. The term "control switch" as used herein includes either on/off switch 2 only, or on/off switch 2 in conjunction with speed control 12.

13 lamp switch—is set up same way as motor on/off switch as described in item 2 above. Preferably an on/-off push button switch is used and hooked up in series with lamp and battery.

14 electric lamp—any lamp drawing generally from ½ to several ampere hours of power may be incorporated, depending on the need of brightness and use or need of the particular swimming or diving task.

15 shroud mounts—are fashioned of aluminum to provide strength, rust proof ability and benefit of being light weight. Strong plastics would also be an ideal alternative to metal materials.

Those skilled in the art will envision many other possible variations within the spirit and scope of my invention.

The front end of housing 4 could have a removable nose cap or cone for easy service access to controls, battery and motor for maintenance and repairs. On the side or top of unit an external recharge port may be mounted so as to recharge batteries quickly and conveniently.

A pressure leak test valve could be mounted in a convenient out of way place for checking tightness of all sealing systems that any embodiments might prefer to engage.

It is further suggested that a strobe or blinking type light system be incorporated to aid in night time navigation so divers might keep track of their team members. Such a mentioned strobe or beacon light(s) could be mounted on one or a plurality of sides per unit to increase visual ability and effectiveness.

Another important ramification includes the concept of hooking up the invention device to an external power supply via an optional plug-in power cord. Thereby user is allowed added power and time for extended operations or as a reserve backup. Such accompanying external battery supply would be strapped to the divers waist or strapped to his breathing tank(s).

The scope of the invention is to be determined by the appended claims and their legal equivalents, and not solely by the illustrations, embodiments, examples and ramifications that have been presented within these specifications.

What is claimed is:

1. An underwater propulsion device for an individual of the type in which a battery-driven motor in a housing operates a propeller, in which the improvement comprises:

A single housing containing the battery and motor lying along the line of maximum thrust of the propeller, said single housing also containing a control switch on the forward end, and a plurality of strap attachments to attach the housing of the device along the forearm of the user, and switch means on the forward surface of the housing, located within reach of the user's fingers on the forearm to which the device is attached for switching the motor on and off, and a shroud around the propeller which serves the threefold purpose of protecting the user, preventing fouling of the propeller, and increasing the efficiency of the propeller.

2. An underwater propulsion device for an individual of the type in which the shaft of a battery-driven motor in an otherwise sealed housing passes through a rotary seal to operate an external propeller, comprising:

A single housing containing the battery and motor lying along the line of maximum thrust of the propeller, said single housing also containing a control switch on the forward end, and at least one protuberance on the housing for nesting the device along the forearm of the user, and switch means on the forward surface of the housing located within reach of the fingers belonging to the forearm to which the device is attached, for switching the motor on and off, and a plurality of strap attachments to attach the housing of the device along the forearm of the user, and speed control means located within reach of the fingers of the forearm to which the device is attached, and a shroud around the propeller, said shroud being spaced from the housing and mounted to the housing.

3. An underwater propulsion device for an individual in which the shaft of a battery-driven motor in an otherwise sealed housing passes through a rotary seal to operate an external propeller, comprising:

A single housing containing the battery and motor lying along the line of maximum thrust of the propeller, said single housing also containing a control switch on the forward end, and at least one protuberance on the housing for nesting the device along the forearm of the user, and a plurality of strap attachments to attach the housing of the device to the forearm of the user, and switch means on the forward surface of the housing located within reach of the fingers belonging to the forearm to which the device is attached, for switching the motor on and off, and speed control means located within reach of the fingers of the forearm to which the device is attached, and a shroud around the propeller, said shroud being mounted on the housing, and propulsion water inlet means protruding beyond the surface of said single housing, located between the aft end of the housing and said shroud.

4. An underwater propulsion device as described in claim 1, further comprising:

an electric lamp located in the forward portion of the watertight housing, and second switch means for connecting said electric lamp to the battery.

5. An underwater propulsion device as described in claim 3, further comprising:

an electric lamp located in the forward portion of the sealed housing, and second switch means for connecting said electric lamp to the battery.

* * * * *